United States Patent [19]

Patterson

[11] Patent Number: 4,785,705

[45] Date of Patent: Nov. 22, 1988

[54] COMPONENT MULTI-NECK STRINGED INSTRUMENT SYSTEM

[76] Inventor: Jeffrey D. Patterson, 1207 S. Lincoln Ave., Lakeland, Fla. 33803

[21] Appl. No.: 884,984

[22] Filed: Jul. 14, 1986

[51] Int. Cl.[4] ..... G10D 1/08; G10D 3/00; G10G 5/00; G10H 3/18

[52] U.S. Cl. ..... 84/1.16; 84/263; 84/267; 84/327

[58] Field of Search ..... 84/1.16, 263, 291, 267, 84/327, 173, 312 R; D17/14, 15

[56] References Cited

U.S. PATENT DOCUMENTS

| | | | |
|---|---|---|---|
| Re. 31,722 | 11/1984 | Steinberger . | |
| D. 34,476 | 5/1901 | Nordwall . | |
| D. 278,632 | 4/1985 | Erlewine . | |
| 964,660 | 7/1910 | Laurian . | |
| 1,183,369 | 5/1916 | Gardie . | |
| 1,304,914 | 5/1919 | Smith . | |
| 1,759,736 | 5/1930 | Dodson et al. . | |
| 2,838,974 | 6/1958 | Fender . | |
| 3,251,257 | 5/1966 | Bunker . | |
| 3,823,245 | 7/1974 | Suzuki | 84/DIG. 17 |
| 4,192,213 | 3/1980 | Steinberger . | |
| 4,201,108 | 5/1980 | Bunker . | |
| 4,240,319 | 12/1980 | Soupios . | |
| 4,241,637 | 12/1980 | Brent . | |
| 4,329,904 | 5/1982 | Mouteleone | 84/306 |
| 4,343,217 | 8/1982 | Brody . | |
| 4,576,080 | 3/1986 | McLellan et al. . | |

FOREIGN PATENT DOCUMENTS

| | | |
|---|---|---|
| 148174 | 5/1981 | German Democratic Rep. . |
| 689931 | 6/1965 | Italy . |
| 2141282 | 10/1984 | United Kingdom . |

OTHER PUBLICATIONS

*Guitar Player*; "Showcase for New Talent" by Mike Varney, p. 138.

*Primary Examiner*—Stanley J. Witkowski
*Attorney, Agent, or Firm*—Mark Lee Hogge

[57] ABSTRACT

A component multi-necked string-instrument is disclosed. At least two instruments are flexibly connected to enable multiple instrument playing with fluidity and ease. The instruments are reverse-strung, stream-lined, having conventional tunings means angularly recessed rearward of the bridge section. Electrical control means are likewise recessed. A limited headstock is also provided for string anchoring, balance and playing ease.

15 Claims, 4 Drawing Sheets

FIG. 1
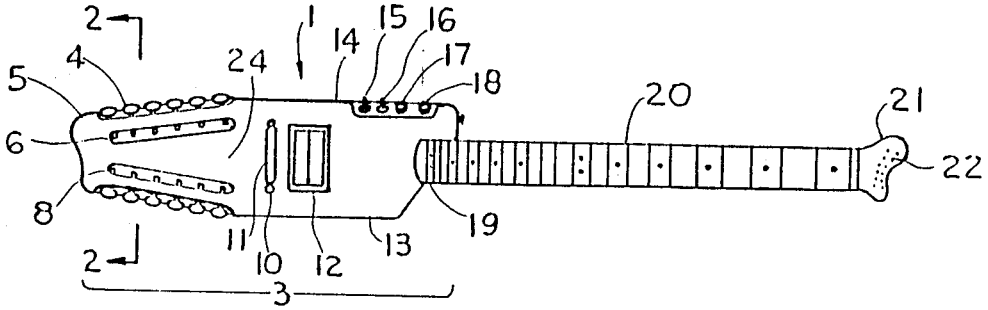
FIG. 2
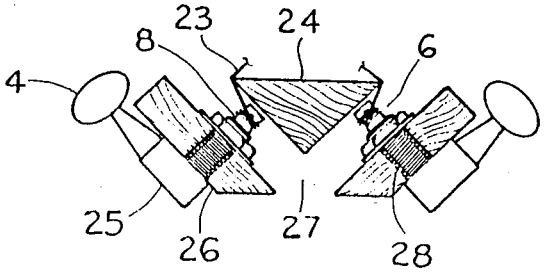
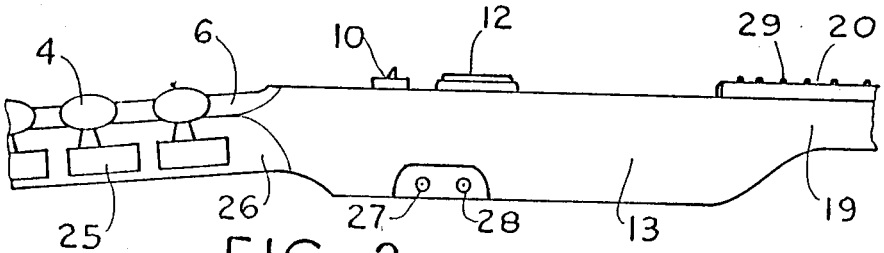
FIG. 3
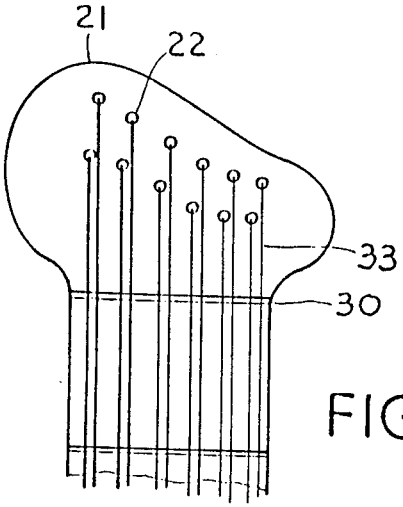
FIG. 4
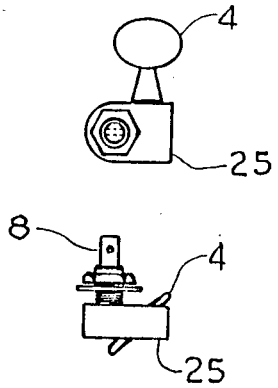
FIG. 5

FIG. 9
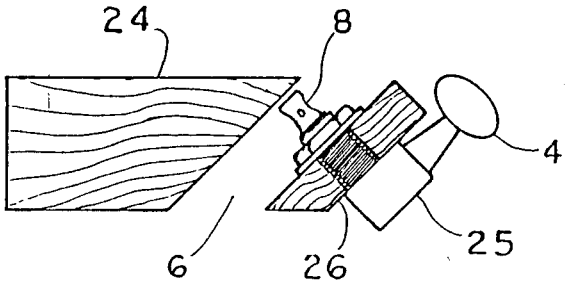
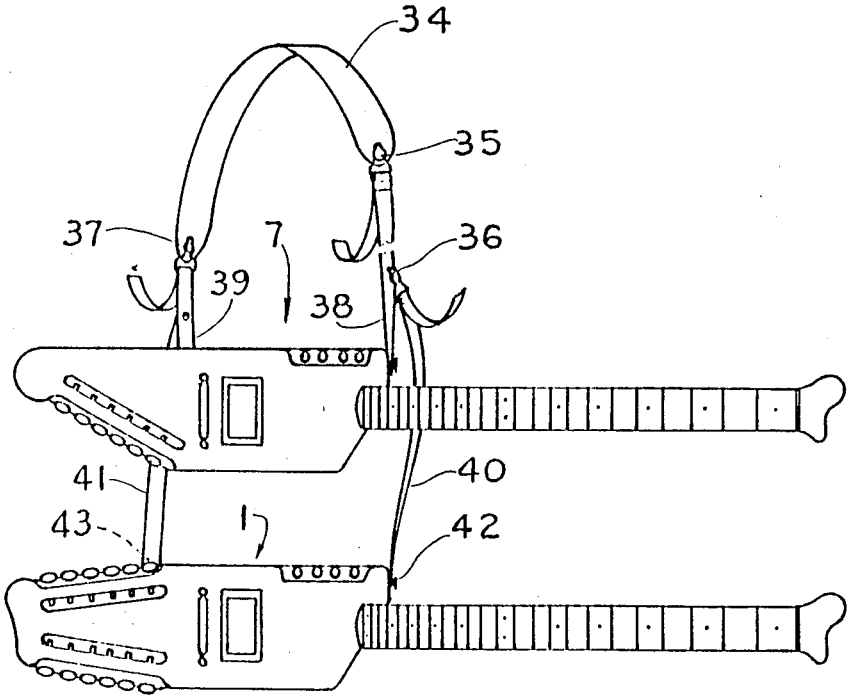
FIG. 10

FIG. 11
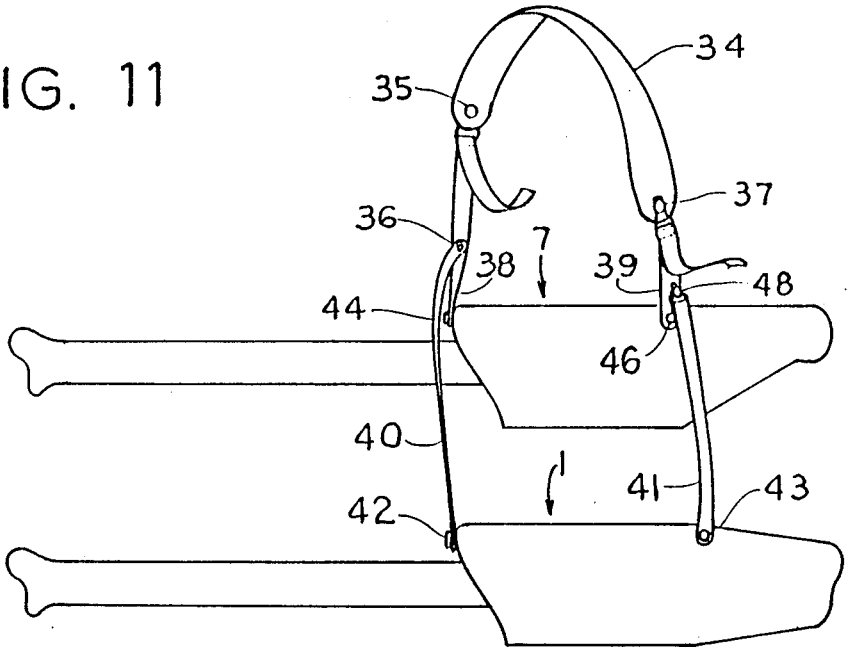
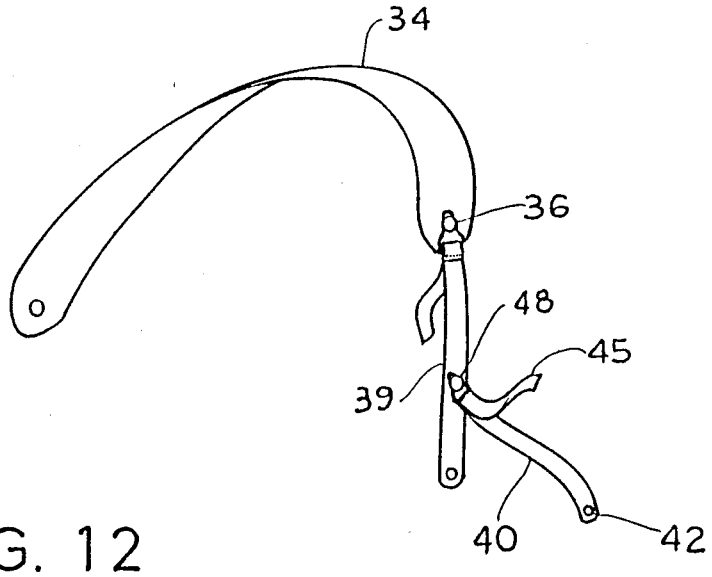
FIG. 12

COMPONENT MULTI-NECK STRINGED INSTRUMENT SYSTEM

TECHNICAL FIELD

This invention relates to assemblies for multiple stringed instruments wherein the assemblies are designed to depend from the neck of a player presenting at least two instruments to be played in close proximity. More in particular, the invention relates to plural stringed instruments constructed to be played in close adjustable relationship with each other.

BACKGROUND OF THE INVENTION

The wearing of plural stringed instruments, e.g., two guitars, is desirable at times. For example, a typical situation is where a band has limited personnel and a particular piece of music calls for several guitars, e.g., a twelve-stringed guitar and a six-stringed guitar. In such a situation the guitar player would have to set one instrument down before picking the other one up for playing or wear both guitars in close proximity to each other. The latter situation is the more desirable because the guitar player is able to move quickly and fluidly from one instrument to the other without losing a sense of continuity in the performance of a particular piece of music.

There are problems with configurations for plural stringed instruments. Typically, the configurations are bulky, and the instruments are in fixed relation to each other. The bulkiness makes the instruments unwieldy and difficult to play. The fixed or rigid relation between the instruments, e.g., a double-necked guitar, limits the number of spatial arrangements possible between the instruments. Stringed instruments are often played in a variety of situations and by a variety of players. Rigidly connected multiple stringed instruments are therefore usually designed with one player in mind (or one position in mind).

Notwithstanding the attendant problems associated with such multiple instrument configurations, examples and teachings of such configurations exist. Double-necked guitars and the like are typically a one piece connection or two rigidly connected guitars.

CONKLIN GUITARS provides QUICK-CONNECT DOUBLE-NECK guitars. These are rigidly connected guitars with traditional head stock mounted tuning gears. These are available from the company at P.O. Box 1418, Lebanon, Mo., 65536. There is a patent application pending.

One piece construction formats containing plural instruments are known. Examples of such instruments are: U.S. Pat. Nos. Des. 34,476; 964,660; 1,183,369; 1,759,736; Italian Pat. No. 689,931; U.S. Pat. Nos. 4,250,319; and 4,343,217.

Reverse strung guitars are known. Examples of such instruments are: U.S. Pat Nos. 3,251,257; 4,201,108; East German Pat. No. 148,174; U.S. Pat. Nos. 4,192,213; Re. 31,722; 4,576,080; Des. 278,632; and 4,241,637. Reverse strung guitars heretofore have not been constructed to be flexibly connected to other guitars. Accordingly, they suffer from protruding or inconveniently located tuning means. Such inconveniently located tuning means present difficulties to players having several such instruments depending from their necks. This is because when instruments are connected in close proximity and in substantially coplanar alignment one instrument must be reached over to play a lower instrument.

The present invention provides structure and function to enable the comfortable playing of plural stringed instruments. The instruments are reverse strung, stream lined, light weight, constructed to be flexibly connected, and with no interference with the rearward mounted tuning means.

SUMMARY OF THE INVENTION

The invention comprises a component multi-necked stringed instrument device wherein plural stringed instruments are flexibly connected. The instruments have been so constructed that they can be played in close proximity when in substantially coplanar and substantially vertical alignment. Adjusting means have been provided for adjusting the spatial relationships between the plural instruments, e.g., angular and distance relationships. The instruments are reverse strung having the strings anchored in the headstock and the tuning means, e.g., worm gears, located rearward of the bridge section. So that one instrument may be overreached to play a lower instrument, the tuning means have been mounted on the body in recesses at angles. The instruments are stream lined, i.e., narrow, for being played in close proximity. To enable the streamlining, each tuning means for each string has been mounted in linear fashion on a line having an acute angle to a central longitudinal axis of the instrument body. It should be noted that the recessing of the tuning means can be effected in grooves, slots or individual holes.

Preferably the instruments are electrified having their sound produced by electronic means. Each instrument has therefore been provided with input and output means for electronically communicating with other such instruments. According to the invention, the instruments can each function as a host for other instruments, i.e., they can relay signals form other instruments.

The connecting means for the instruments is preferably a cord or strap. It is essential that whatever the flexible connecting means is, it should be compatible with strap means as are usually used for depending electronic stringed instruments from the necks of the musicians. Including with the flexible connecting means is an adjusting means, e.g., a buckle or buckles, for adjusting the spatial relationships existing between plural depending stringed instruments. The adjusting means can effect changes in the angular relationships as well as proximity. The stringed instruments are selected from the group consisting of 6-stringed guitars, twelve-stringed guitars, bass guitars, and mandolins.

Each instrument of the invention has a neck with a headstock mounted on one end for anchoring the strings. On the end of the neck is mounted a body. The body is generally elongate in shape having a transducer mounted in proximity to the strings forward of the string-supporting bridge section. The tuning means are located in slots rearward of the bridge section. The preferred embodiment of the invention comprises conventional tuning gears, e.g., worm gears, wherein the winding peg is angularly mounted in the recesses. Angled toward the body's back side are located the turning knobs for turning the pegs and thus winding the strings. Because the instruments must be streamlined to enable close proximity playing of plural instruments, the tuning means are linearly arranged at an acute angle to the longitudinal axis of the body. In accordance with an object of the invention to prevent any structure from interfering with the playing thereof, the electronic control means are preferably located along longitudinal edges, e.g., top horizontal edge, increased angular arrangement.

The individual instruments are selected from the group consisting of twelve-stringed guitars, six-stringed guitars, bass guitars and mandolins. According to the invention, any mixture of the above enumerated instruments may be flexibly connected.

These and other and further objects and features of the invention are apparent in the disclosure, which includes the foregoing and following specification, claims and drawings.

BRIEF DESCRIPTION OF THE DRAWINGS

While the specification concludes with claims particularly pointing out and distinctly claiming the subject matter that is regarded as forming the present invention, it is believed that the invention will be better understood from the following description accompanied by the following drawings in which:

FIG. 1 is a plan view of a revers strung twelve-string guitar;

FIG. 2 is a cross-section of FIG. 1 taken along line 2—2;

FIG. 3 is a side view of FIG. 1 taken along line -3-;

FIG. 4 is a plan view blow-up of the headstock 22 of FIG. 1;

FIG. 5 is a plan view of facets of elements 4 and 8 of figure one;

FIG. 9 is a cross-section of FIG. 7 taken along line 37—37;

FIG. 10 is a front plan view of the preferred embodiment;

FIG. 11 is a back plan view of FIG. 10;

FIG. 12 is a perspective of the flexible connecting means, adjusting means and strap means.

DESCRIPTION OF THE PREFERRED EMBODIMENTS

Figure 6:
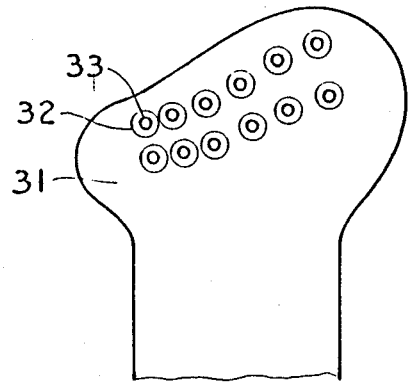
FIG. 6 is a back plan view of FIG. 4.

The preferred embodiment of the invention comprises an assembly as depicted in FIGS. 10 and 11. Referring to those figures, there is a six- stringed electric guitar 7 connected to a twelve-stringed electric guitar 1 by flexible connectors 38, 39, 40, and 41. The flexible connectors may be anything which is not rigid, e.g., cords (both elastic and non-elastic). Belt-like material is especially preferred as this type of structure is amenable to adjustment mechanisms 35,36,37 and 46. These mechanisms may be buckles or anything for shortening and lengthening the flexible connectors 38, 39, 40 and 41. Strap means 34 connects the various flexible connectors such that guitars 1 and 7 may be positioned in a depending position about the neck of a guitarist. The various connecting points 35, 36, 37, 46, on the flexible connector can be constructed out of any fastening means, e.g., staples, rivets buckles, bonding agents etc. The various connecting points 42, 43, 44 and 46 for connecting the flexible connector to the plural instruments 1, 7 can be any means for fastening such as strap locks, buttons etc. Moreover, points 42, 43, 44, and 46 need not be connected at the places indicated in the figures.

Referring to FIG. 1 there is indicated a reverse-strung twelve-stringed guitar 1, having mounted rearward of the bridge 10 angularly recessed tuners 4 and 8. These tuners are conventional worm gear tuners as shown in FIG. 5. The preferred worm gear tuners are made by GROVER.

FIG. 2 shows the preferred mounting of the tuners. There is a slot 6 having located therein winding pins 8. Winding pins 8 extend through angular surface 26. The gear box 25 is mounted on the back side 26. (See also, 26 on FIG. 3.) Broken line 28 shows the through-hole through which the winding peg extends.

FIG. 3 shows the input and output means 27 and 28 for electrically communicating with the electronic producing means 12. Element 12 may be any type of sound producing means, e.g., pickup, microphone, transducer, etc. The electronic control means 15, 16, 17 and 18 are recessed in longitudinal edge 14 of guitar 1 as shown on FIG. 1. It should be noted that the recessing of most of the hardware of the invention is essential to plural instrument configurations as is depicted in FIGS. 11 and 12. Lack of recessing makes the instruments difficult to maneuver about.

Typical of reverse strung guitars, the strings 33 as best shown in FIG. 4 are anchored beyond the nut 30. However, not so typical of reverse strung guitars is the headstock 21 providing holes 22 for anchoring the strings 30 on the back side 31 as shown in FIG. 6. Recessing of the string ends 33 in holes 32 is preferred in accordance with an object of the invention, namely, to provide non-interfering surfaces for playing convenience. The providing of a little bit of head stock beyond the nut is preferred by most guitarists to enable string bending of open string notes.

Figure 7:
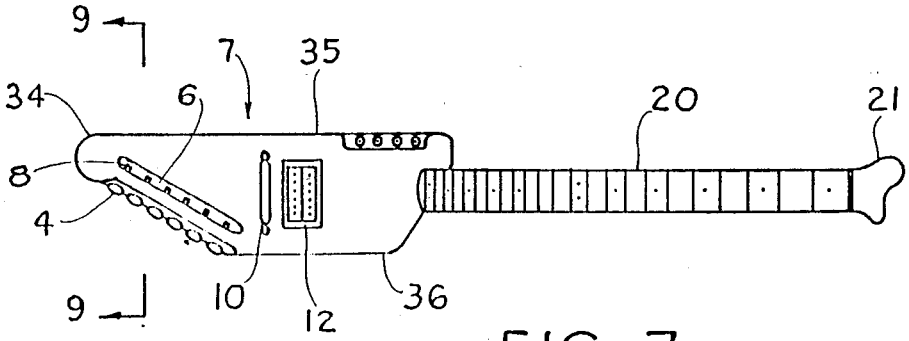
FIG. 7 is a front plan view of a six-stringed guitar.

Referring now to FIG. 7, there is provided another component of the system shown in FIGS. 11 and 12. Six-stringed guitar 7 only one side of the body 36. The top edge 35 is free of tuning means 4 and 8. It is generally preferred that guitar 7 be the top guitar so that a players arm may rest on edge 35 just forward of back piece. A slight indentation may be placed on edge 35 to provide for more comfortable arm resting.

Figure 8:
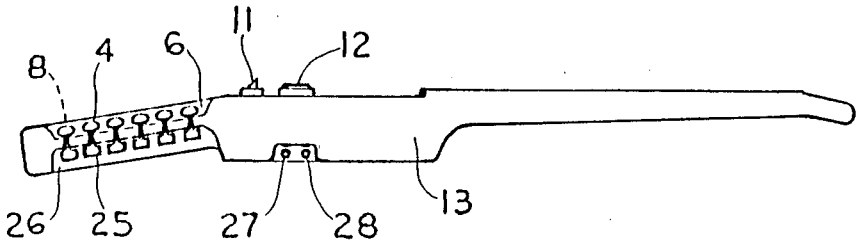
FIG. 8 is a side view of FIG. 7.

Referring to FIG. 8, there is mounted gear box 25 on the back angular side 26. As in guitar 1 there is input and output means 27 and 28. Interchangeability is an important feature of the present invention. It is noteworthy that either of the guitars 1 and 7 may function as a relay for the other guitar. They may both be played at the same time or first one then the other.

FIG. 9 shows the angularly recessed tuner means of guitar 7. Downward facing face 26 has mounted thereon tuning gear 25. Projecting through face 26 is the winding peg 8. It is to be noted that turning knob 4 is at least even with the front body surface.

Those ordinarily skilled in the art will readily understand that the materials used to construct the invention are available in the marketplace. Woods, composites of plastic and fiber, laminates, various hardware described hereinabove are all suitable for use in constructing the above described invention.

As this invention may be embodied in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What I claim as my invention is:

1. A multinecked stringed instrument device, comprising:

(a) at least two stringed instruments, wherein said instruments are adapted to be played adjacent each other in close proximity and in substantially vertical coplanar alignment, where each of said instruments comprise a body having first and second ends, a front side and a back side and a neck connected to said first end of said body, and wherein at least one of said instruments is reverse strung and having tuning means mounted near the second end on a surface angled towards the body's back side, said surface being recessed from the body's front side, said tuning means being linearly aligned at an acute angle to a longitudinal axis of the said body;

(b) flexible connecting means connecting said instruments, said flexible connecting means further comprising spatial adjusting means for adjusting said proximity between said instruments.

2. The device of claim 1 where each of said instruments further comprises electrical sound producing means, each of said instruments further comprising input and output means, whereby the instruments are electronically connected.

3. The device of claim 2 wherein each instrument has host means, whereby at any given configuration of instruments one instrument is a relay for another instrument.

4. The device of claim 3 further comprising strap means connected to said flexible connecting means.

5. The device of claim 4 wherein said flexible connecting means comprises a cord or a belt.

6. The device of claim 5 wherein said means for adjusting comprises a buckle or length adjusting means.

7. The device of claim 6 further comprising recessed electronic control means located on axial edges of said body, wherein said edges are angled towards said backside.

8. The device of claim 7 where the instruments are selected from the group consisting of twelve-stringed guitars, six-stringed guitars, bass guitars and mandolins.

9. A stringed instrument device, comprising:

(A) a neck having first and second ends;

(B) a head connected at said first end for anchoring strings;

(C) a body having first and second ends, wherein said first end of said body is connected to said second end of said neck, wherein said body is narrow to be played adjacent another stringed instrument device in close proximity and in substantially vertical coplanar alignment therewith;

(D) tuning means mounted on a recessed surface angled towards a backside of said body, wherein said tuning means is located near the second end of said body for adjusting tensions on said strings, said tuning means being linearly aligned at an acute angle to the longitudinal axis of the device, whereby the tuning means do not interfere with a player playing said another stringed instrument flexibly connected to said device.

10. The device of claim 9 further comprising electronic sound producing means, said device further comprising input and output means for providing electronic communication with said sound producing means, whereby said device functions as a relay for another electrical instrument connected thereto.

11. The device of claim 10 further comprising electronic control means recessed on a surface which is angled towards said backside, wherein said control means is located along longitudinal edges of said body.

12. The device of claim 11 wherein said device further comprises a twelve-stringed guitar, a six-stringed guitar, a bass guitar or a mandolin.

13. A component multi-necked stringed instrument device comprising:

(A) at least two string-instruments, wherein at least one instrument is a twelve-string guitar, each instrument having a neck connected to a first end of a body;

(B) flexible connecting mean for connecting said instruments in close proximity substantially coplanar alignment;

(C) adjusting means located on said flexible connecting means for adjusting distances between said instruments;

(D) electronic sound producing means on each of said instruments;

(E) input and output means on each of said instruments for electrical communications between each of said sound producing means of said instruments;

(F) tuning means recessed on a surface angled towards a backside on each of said instruments, said tuning means being located near a second end of said body, said tuning means being linearly aligned at an acute angle to a longitudinal axis of said body.

14. The device of claim 13 wherein said tuning means are worm gear tuners.

15. The device of claim 14 comprising strap means removably connected to said device for depending said device from the neck of a player.

* * * * *